United States Patent [19]

Laramore

[11] Patent Number: 4,631,878

[45] Date of Patent: Dec. 30, 1986

[54] PEDESTAL AND FRAMING SYSTEM FOR SUPPLEMENTAL ROOF CONSTRUCTION

[76] Inventor: Larry W. Laramore, 22526 108th Ave. SE., Kent, Wash. 98031

[21] Appl. No.: 683,708

[22] Filed: Dec. 19, 1984

[51] Int. Cl.[4] ..... E04B 7/02; E04G 25/08

[52] U.S. Cl. ..... 52/90; 52/126.6; 248/354.5; 248/188.5

[58] Field of Search ..... 52/90, 199, 302, 22, 52/126.1, 126.3, 126.5, 126.6; 248/354.5, 188.5

[56] References Cited

U.S. PATENT DOCUMENTS

| | | | |
|---|---|---|---|
| 359,318 | 3/1887 | Gavitt . | |
| 468,924 | 2/1892 | Wynne | 52/90 |
| 830,216 | 9/1906 | Ducker . | |
| 837,067 | 11/1906 | Jamison | 52/704 |
| 1,375,043 | 4/1921 | Finlayson | 52/126.6 |
| 1,730,618 | 10/1929 | Mayo | 248/354.5 |
| 1,882,477 | 10/1932 | Bonsall . | |
| 1,961,373 | 6/1934 | Mayhew . | |
| 2,459,415 | 1/1949 | Cibulka | 52/302 |
| 2,683,903 | 7/1954 | South | 52/90 |
| 2,777,660 | 1/1957 | Albrecht | 248/354.5 |
| 2,877,875 | 3/1959 | Bolt | 52/126.3 |
| 3,184,800 | 5/1965 | Nelson | 52/90 |
| 3,204,910 | 9/1965 | Gacher | 248/354.5 |
| 3,316,680 | 5/1967 | Chrastek | 52/126.6 |
| 3,355,136 | 11/1967 | Staples | 248/354.5 |
| 3,423,898 | 1/1969 | Tracy et al. | 52/665 |
| 3,738,602 | 6/1973 | Arnett | 248/354.5 |
| 4,003,167 | 1/1977 | Saunders | 52/90 |
| 4,078,353 | 3/1978 | Thesingh | 52/92 |
| 4,142,335 | 3/1979 | Andrade | 52/282 |
| 4,261,143 | 4/1981 | Rizzo | 52/92 |
| 4,314,428 | 2/1982 | Bromwell | 52/22 |
| 4,408,423 | 10/1983 | Lautensleger et al. | 52/90 |
| 4,449,335 | 5/1984 | Fahey | 52/90 |
| 4,541,215 | 9/1985 | Nicklay et al. | 52/479 |

FOREIGN PATENT DOCUMENTS

| | | | |
|---|---|---|---|
| 145854 | 6/1985 | European Pat. Off. . | |
| 1942527 | 3/1971 | Fed. Rep. of Germany . | |
| 3039112 | 5/1981 | Fed. Rep. of Germany . | |
| 3004425 | 9/1981 | Fed. Rep. of Germany . | |
| 1387785 | 12/1965 | France | 248/354.5 |
| 2542787 | 9/1984 | France . | |

*Primary Examiner*—Carl D. Friedman
*Assistant Examiner*—Michael Safavi
*Attorney, Agent, or Firm*—Christensen, O'Connor, Johnson & Kindness

[57] ABSTRACT

A pedestal (18) for use in conjunction with a framing member (11) to support a supplemental roof (16) in superposed spaced relation to a deck roof (10) or other primary roof of a building. Since blanket or other conventional insulation can be placed in the spaces between the primary and supplemental roofs and between adjacent pedestals, the aesthetics of the exposed plank ceiling are preserved. To transfer vertical loading, each of the pedestals (18) is positioned to overlie, and be anchored to, a framing member (14, 15) of the primary roof. At the peak (P) of the roof, complementary configured tabs (38) and receptacles (40) interconnect the adjacent pedestals. Use of wider framing members (11) or an optional extension cap (44) and spacer block (42) increases the spacing between the primary and supplemental roofs to accommodate additional insulation. To avoid condensation and conductive heat losses, the pedestal, extension cap, and spacer block are each preferably single pieces of plastic, with the pedestal and spacer block having honeycomb cores (28, 43) that are filled with an insulating material.

35 Claims, 11 Drawing Figures

PEDESTAL AND FRAMING SYSTEM FOR SUPPLEMENTAL ROOF CONSTRUCTION

BACKGROUND OF THE INVENTION

The present invention relates generally to building construction. More particularly, the invention concerns a device and framing system for use in supporting a supplemental roof in superposed spaced relation to the primary roof of a building so that insulation may be provided on the exterior side of the primary roof.

Plank, post, and beam building systems have been used for many years in the construction of roof structures. Since these so-called "deck roofs" provide an exposed ceiling of planks and beams, which when finished, is aesthetically pleasing, they have heretofore been widely popular with consumers.

In addition to providing aesthetic benefits, planked roof construction was also very popular for many years because of the low labor costs associated with its installation.

As energy costs have escalated significantly, the provision of adequate insulation for the roof of a building has become a paramount concern. For new construction, local building codes almost universally require that minimum standards of insulation be met. Where such codes are in force, post-and-beam plank roof construction has been virtually eliminated for residential roof construction. This significant decline in deck roofing has occurred because of the difficulties associated with adequately and economically insulating this type of roof. Since homeowners are interested in preserving the appearance of the plank ceiling, insulating on the underside of the roof is a workable, but not desirable, option. The only option then has been to provide the insulation on the outer side of the roof. According to one approach, sheets of rigid insulation are nailed in place directly on the planks that form the deck roof. Thereafter, layers of building paper and shingles are placed atop the insulation. Since there is no airspace between the rigid insulation and roofing material, there are serious condensation problems with this approach. As well, to obtain a satisfactory amount of insulating effect, the sheets of rigid insulation must be thick, e.g., approximately three inches to obtain an R30 insulating value. As a result, conventional roofing nails cannot be used and resort must be had to large spikes that may penetrate completely through the roofing planks and be visible on the ceiling. To avoid these problems, another prior approach has been to construct a second roof over the deck roof using large rafters or a truss structure. While these arrangements enable the placement of insulating batts or blankets between the rafters or trusses, they do so by significantly increasing the cost of construction, both in terms of material and labor.

In the known approaches that utilize a rafter arrangement, two-by-twelve framing materials are typically chosen in an effort to maximize the thickness of insulating material. As a general rule, two-by-twelve materials are the largest framing members that are readily available in a lumber yard. In actuality, the net dimensions of the two-by-twelves are 1½ inches by 11¼ inches. Twelve-inch-thick blankets of insulation, which yield an insulating value of R38, cannot be easily fitted into a void created by using two-by-twelve materials. It will be appreciated that even if this were possible, it would not be desirable since there would be no remaining airspace between the insulation and the supplemental roof. The omission of a space for air movement has critical import, both in the context of heating loads and cooling loads. Without adequate airspace in the heating situation, condensation occurs, wetting the insulation. In hotter climates, where air conditioning rather than heating is a concern, a large air void is required to exhaust heated air below the roof so that it does not enter the home or building. Under these circumstances, an even larger air void is necessary.

In view of these concerns, smaller blankets of insulation, such as those 8 to 8½ inches thick, which yield about an R30 insulating value, must be used with two-by-twelve rafters. In cold areas in particular, this is an insufficient amount of insulation. To achieve higher values of insulation, it is accordingly necessary to resort to the extremely costly option of a flat truss structure. The same option must be chosen in those areas where the air conditioning load is the principal concern. In these areas, a large airspace rather than a heavy blanket of insulation is more important for cooling. In general, a two-by-twelve rafter does not yield a desirable space that would provide the correct combination of insulation thickness and air gap.

A solid two-by-twelve rafter construction for a supplemental roof suffers from another disadvantage. Even if the thicknesses of insulation and airspace might be adequate for a milder climate, the arrangements of rafters spanning the space between the supplemental and primary roof restricts air movement to a direction from eave to ridge in the spaces between adjacent rafters. Greater effectiveness in the removal of warm air for cooling purposes and less likelihood of condensation in heating situations would occur if it were possible to enable air movement from gable end to gable end of a building in addition to movement from eave to ridge.

There still remain a substantial number of older residences and buildings that have uninsulated deck roofs. If the owners of these buildings are interested in insulating the roofs, they are faced with the choices presented to the new building contractor. Thus, they must choose among destroying the aesthetics of the cathedral ceiling by insulating on the underside of the roof, opting for only marginally effective rigid insulation, or expending considerable sums to build a second roof with rafters or trusses. As noted above, rafter construction yields less than desirable insulating results in many situations.

The present invention provides an arrangement that overcomes the disadvantages of the developments described above. In particular, the invention provides a device and framing system that can be used to easily and economically support a supplemental roof above a primary roof of a building. Since the device and system are readily adapted to provide a number of different spacings between the supplemental and primary roof, the invention enables insulating the outer surface of the primary roof to equal or exceed the R-value mandated or suggested by building codes for new construction and remodeling. While the invention is particularly suited for use with deck roofs, it is also useful as a means for insulating both new and old truss roofs having pitches too low to provide enough room for adequate ceiling insulation and airspace above the insulation.

Of particular advantage is the invention's enablement of the use of smaller framing materials, i.e., two-by-four and two-by-six members, in lieu of a two-by-twelve rafter to provide the support for a supplemental roof. These smaller framing members not only cost significantly less than their larger counterparts, but are much easier to handle so that they may be lifted to the roof and cut to proper size. As a result of this ease of use, labor costs are also favorably impacted so that the overall cost of the supplemental roof is kept low. Unlike the solid rafter approaches that block the movement of air in a crosswise direction, the inventive arrangement yields an open space above the insulation through which air may circulate in any direction. The invention is particularly concerned with ensuring that the thickness of insulation as well as the airspace above it are complementary to one another and adapted to optimize either heating or cooling requirements.

SUMMARY OF THE INVENTION

In accordance with the invention, there is provided a device and system for use in supporting a supplemental roof in superposed spaced relation to a primary roof of a building. The device comprises a pedestal having opposed first and second ends. The first end is constructed so as to be mounted on the primary roof of the building while the second end has a channel that is constructed and arranged to receive a framing member of the supplemental roof and orient the same in spaced relation to the primary roof.

According to a preferred aspect of the invention, the pedestal is a universal device that, when used in conjunction with like-configured pedestals and conventional wooden framing members, can be employed to support a supplemental roof over a primary roof, regardless of the pitch and type of construction, i.e., regardless of whether the primary roof has boards, plywood sheathing, or the like.

The framing system for the supplemental roof is formed by positioning a plurality of like-configured pedestals at spaced-apart locations on the boards or plywood sheathing for the primary roof. To transfer the vertical loading of the supplemental roof, each of the pedestals is positioned to overlie a framing member of the primary roof. Fastening means, such as one or more lags driven into the framing member securely anchor the pedestals in place. The pedestals are preferably arranged in groups so that the channels in one or more of the pedestals are cooperatively aligned to receive a single wooden framing member. By arranging similarly aligned combinations of pedestals and framing members in side-by-side relationship to one another, a rafter-like framing system is formed on one side of the roof. By providing a similar arrangement on the opposite side of the roof, a completed framework is provided so that the supplemental roof can be finished using conventional roof construction techniques. Since the framing technique involves only mounting the pedestals in the desired positions, cutting the framing members to a suitable length, and securing the same in the channels of the pedestals, the framework for the supplemental roof can be quickly constructed. As a result, the labor costs and the material costs can be kept to a minimum so that the ultimate cost of the insulating project, i.e., the supplemental roof, the additional framework, and the insulation material, can be consistently maintained equal to or less than the costs of insulating deck roofs using the known techniques.

Conductive heat losses through the rafters or other framing members have been a continuing insulating problem. Since, with the inventive arrangement, insulating material can be placed under the supplemental framing members and between the spaced-apart pedestals, this problem of conductive heat loss can be avoided. According to an additional aspect of the invention, the problem can be substantially eliminated by constructing the pedestals from a plastic material that is a poor heat conductor. For even greater insulating value, the pedestals can be provided with an insulating core. In preferred form, the core has a honeycomb structure that strengthens the pedestal and provides cells that are filled with an insulating material, such as a foamed in situ polymeric material.

In the preferred embodiment, the channels of the pedestals are configured to receive standard sized framing members, such as two-by-fours for normal loading conditions. Where additional loads must be borne, such as snow loads, larger framing members, such as two-by-sixes or two-by-eights, may be used. Advantageously, use of such larger framing members not only provides the requisite load support, but also increases the spacing between the supplemental and primary roofs so that additional thicknesses of insulation, together with the desired airspace thereabove, can be accommodated. Since the load characteristics of the framing system and the available space for insulation can be made dependent upon the size of the framing member, the pedestal need only be made in a single size. As a result, a distributor or builder is required to stock only one item to meet a variety of construction and insulating needs.

According to an additional aspect of the invention, an extension cap for the pedestal is provided to enhance the ability to adjust the spacing between the primary and supplemental roofs. The extension cap is adjustably mountable upon the pedestal and has a channel that is constructed and arranged to receive the supplemental framing member. In a preferred form, the extension cap has an open-ended cavity that is configured to be complementary to the pedestal. To increase the spacing between the primary and supplemental roofs, the extension cap is placed upon the pedestal either before or after mounting the pedestal on the roof. For additional height, a spacer block is placed in the channel of the pedestal before adding the extension cap. The spacer block may be either a short segment of a framing member, or a separately molded plastic block, including an insulation-filled honeycomb core if desired.

Recognizing that standard thicknesses of insulating blankets are based upon standard lumber sizes, the pedestal, spacer block, and extension cap can be sized accordingly so that blankets of insulation having different thicknesses may be layered to yield the desired insulating value. For example, an R-11 blanket is currently sized to be used with a standard two-by-four, while an R-19 blanket is sized to be used with a standard two-by-six. By using a segment of a two-by-four or two-by-six, or by sizing the plastic block accordingly, the spacing between the primary and supplemental roofs can be quickly and easily extended to automatically accommodate an additional R-11 blanket or an additional R-19 blanket, respectively. With these arrangements, the use of the extension cap assures that there will be a proper airspace above the additional layer of insulation. Again, the ease with which this "on-site" adjustment can be made reduces the amount of labor required to complete a project and, thus, favorably impacts the overall cost.

BRIEF DESCRIPTION OF THE DRAWINGS

Other features and advantages of the present invention will become apparent to one skilled in the art after reading the following description taken together with the accompanying drawings in which.

DETAILED DESCRIPTION

Figure 1:
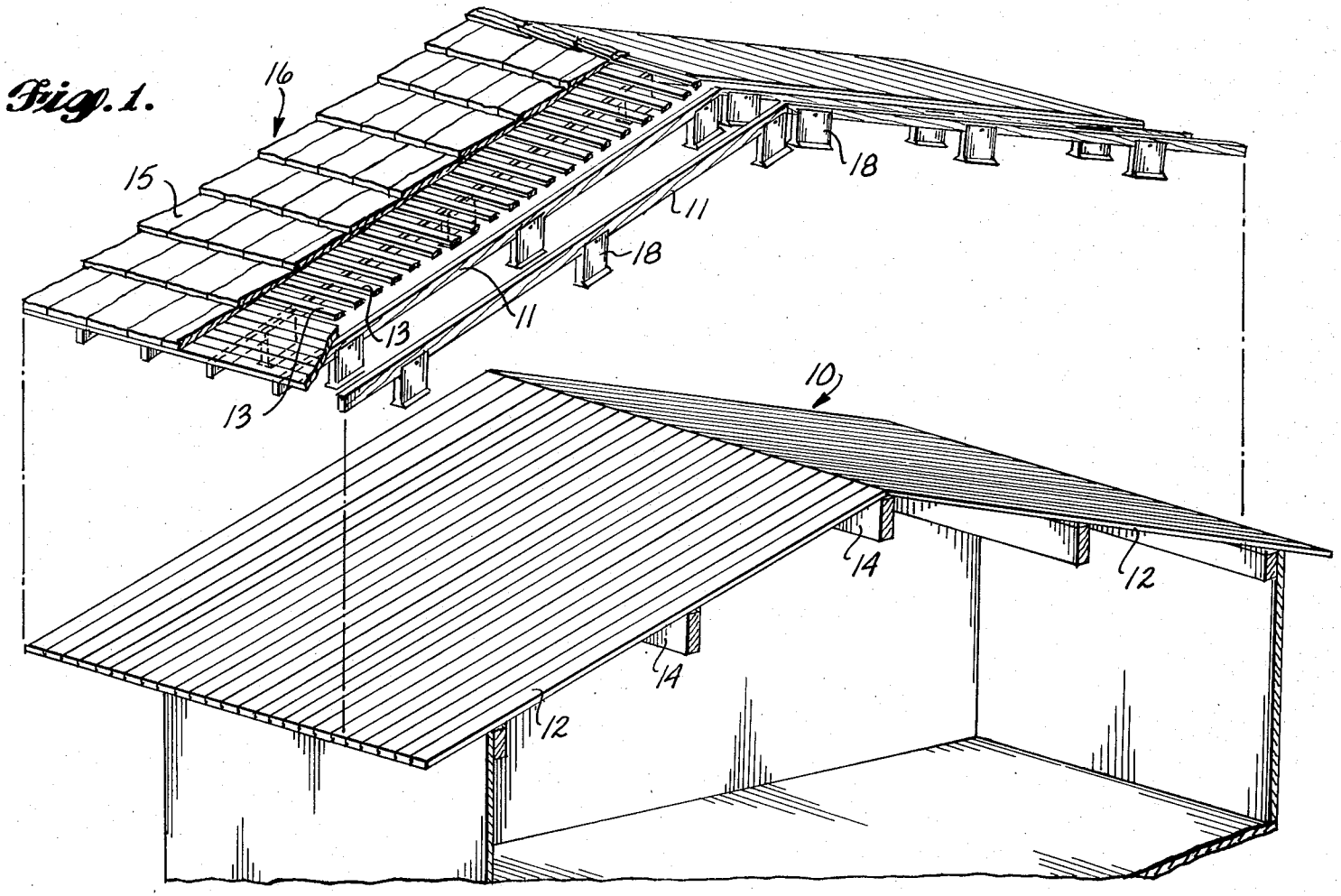
FIG. 1 is a perspective view in partial section showing a supplemental roof and a framing system according to the invention exploded from a deck roof.

Referring to FIG. 1, the primary roof 10 is a conventional deck roof having interconnected planks 12 supported by beams 14. Since the inner surfaces of the planks 12 form an exposed wooden ceiling, which is attractive when finished, this is a particularly desirable type of roof.

In addition to being aesthetically pleasant, the plank roof is attractive from the standpoint of labor and material cost as compared with the conventional rafter roof system. Whereas in the conventional rafter system, the rafter framework is first formed, then the roof is put on, and finally, the ceiling is installed from inside the building; in the plank roof system, the planks as laid atop the beams form both the roof and the ceiling. Thus, the cost of installing a separate ceiling structure is totally avoided.

Figure 2:
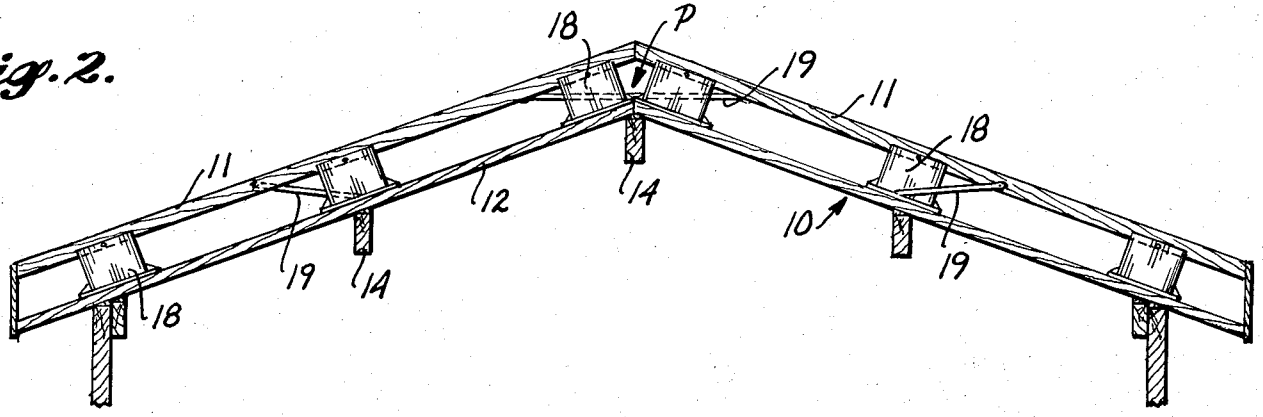
FIG. 2 is a side elevation view showing the positioning of the inventive pedestals relative to the beams of a deck roof.

As noted above, however, the plank roof has been difficult to effectively and economically insulate. To preserve the appearance of this cathedral ceiling, while at the same time enabling insulation, a supplemental roof 16 is supported in superposed spaced relation to the primary roof 10 using a framing system in accordance with the present invention. With reference to FIGS. 1 and 2, the framing system has a plurality of identically configured pedestals 18 that are mounted in cooperating groups at spaced-apart locations on the outer surface of the primary roof 10. As seen in FIG. 2, to transfer the vertical loading of the supplemental roof, each pedestal 18 is positioned above and fastened to one of the underlying beams 14 of the primary roof.

As will be discussed in detail hereinafter, each of the pedestals has a channel at its outer end. For each group of cooperating pedestals, the channels are aligned so that one of the framing members 11 may be received and secured therein. For normal loading conditions, conventional wooden two-by-fours can be used for the framing members 11. Since the pedestals 18 are like-configured, all of the framing members are positioned the same distance above the primary roof 10. It will be appreciated that this system minimizes the amount of labor needed to provide a framework for the supplemental roof 16. Since the spacing between the roofs is assured, no additional measurements are required. Rather, it is only necessary to position and fasten the pedestals, cut the framing members to the required length, and thereafter mount the same in the pedestals. Since the pedestals are mounted flush upon the primary roof, the supplemental roof will naturally mirror the pitch of the primary roof. This aspect of the invention is particularly important where the primary roof involved is of a unique or unusual construction.

Once the framework is in place, the supplemental roof is completed using conventional techniques. In FIG. 1, the use of wooden shakes atop spaced sheathing 13 is an exemplary way to complete a roof. While board, plywood, or other sheathing can be used, it is particularly desirable to use spaced sheathing since the roof can then more easily breathe to prevent moisture condensation in the roof insulation. It is to be noted that the use of spaced sheathing is possible since the primary framework provides the rigidity needed for the supplemental roof.

Insulation may be placed in the space between the supplemental and primary roofs in one of several ways. First, a continuous polymeric vapor barrier should be placed over the deck and overlapped. Next, the preferred approach is to lay batts or blankets of insulation, preferably friction fit tight, directly on the upper surface of the primary roof 10. A greater degree of insulation is obtained with the present invention, since insulation can be placed underneath the framing members 11 in the spaces between the pedestals 18. This is to be contrasted with prior approaches in which insulation can be placed only in the spaces formed between adjacent solid rafters. As noted above, heat losses through conduction occur with these prior approaches.

Alternately, loose insulation can be blown or poured into the insulating space at an intermediate stage in the construction of the supplemental roof.

It is to be appreciated, however, that, as the pitch of the roof becomes steeper, loose insulation becomes a less desirable alternative since it would slip downward toward the eaves of the building. Accordingly, in most instances, the use of loose insulation will be restricted to fairly low-pitched roofs, with friction-fit blankets remaining the generally preferred form of insulation.

Figure 3:
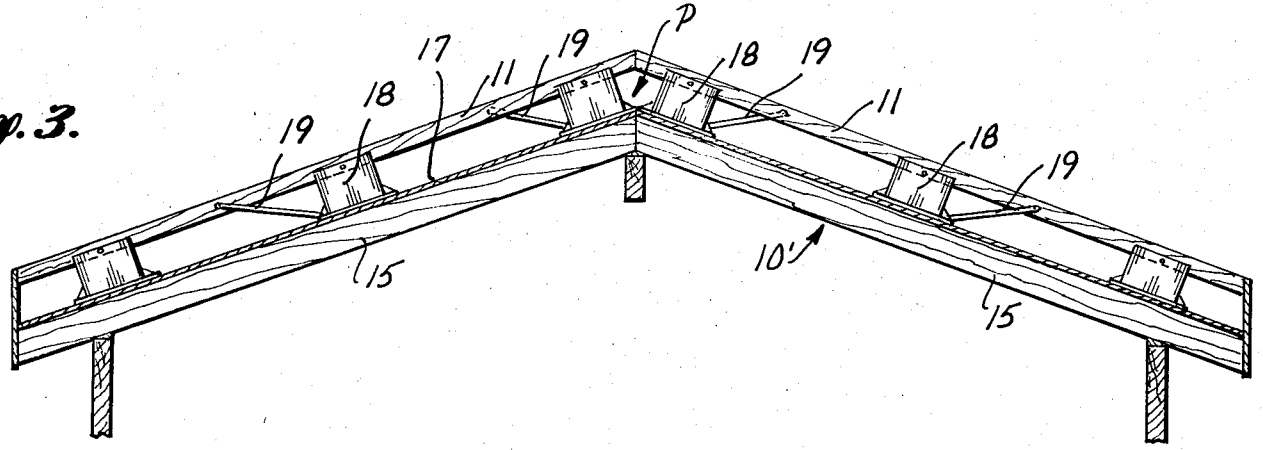
FIG. 3 is a side elevation view showing the positioning of the inventive pedestals relative to the rafters of a truss roof.

While the invention is particularly useful with deck roofs, it may be used with other forms of roof construction. Referring now to FIG. 3, the framing system of the present invention is shown in its installed position atop a primary roof 10' that has a conventional arrangement of rafters 15 for load support. In this arrangement, the pedestals 18 are placed over the rafters 15 to transfer the vertical load of the supplemental roof. As a result, the framing members 11 are positioned above and in parallel relation to the rafters. This is to be contrasted to the arrangement of FIG. 2 in which the framing members 11 are positioned at right angles to the load-supporting beams 14 of the primary roof 10. In each arrangement, the framing system functions in the same manner to transfer the load of the primary roof to the framing members for the primary roof and thence to the rest of the building. In the FIG. 3 arrangement, the particular type of sheathing 17 that is used for the primary roof 10' is not critical to the invention. Thus, plywood, boards, or any other form of sheathing could be used. It is to be appreciated that the arrangement of rafters 15 depicted in FIG. 3 is identical to the arrangement of rafters in a conventional pitched roof. Typically, a horizontal ceiling is provided in the room immediately below the roof. Since there are buildings in which the pitch of the roof is such that there is insufficient space between the roof and the ceiling to provide sufficient insulation and airspace, the present invention provides a viable insulating alternative.

Figure 4:
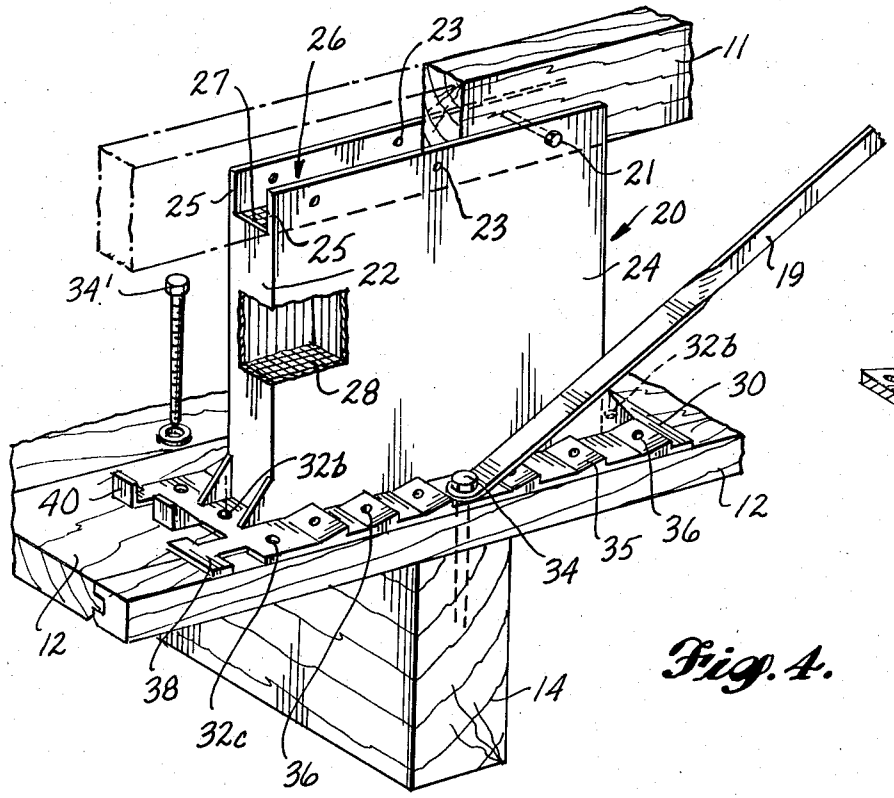
FIG. 4 is an enlarged perspective view, in partial section, of a pedestal according to the present invention, showing the positioning and attachment of the pedestal to the primary roof and the positioning and attachment of the supplemental framing member.

As an optional measure, it may be desirable to ensure that the pedestals take only vertical loads. To avoid overturn, one or more tension straps 19 can be used to connect the framing members 11 to the beams 14 in FIG. 2 or rafters 15 in FIG. 3. The tension straps may be of the metallic type that is customarily used in building construction having a half-twist configuration with mounting holes at the ends. Since the surfaces that bear the mounting holes are oriented at right angles to one another, one end of the tension strap can be positioned flush against a framing member 11 while the opposite end can be positioned flush against a portion of a base 30 of the pedestal. This positioning is shown in FIG. 4, where both the pedestal 18 and tension strap 19 are anchored to the beam 14 by a deep penetrating lag 34.

While metallic tension straps may be used, such construction is not preferred because of the possibility that moisture will condense on the metal straps and wet the insulation. To avoid these problems, it is thus preferred that the tension straps be constructed from a plastic material. Such tension straps could take on a variety of configurations as long as the resultant configuration provides the functional objectives of the tension straps.

To reduce heat loss through conduction and to achieve low cost of manufacture, the pedestal 18 is preferably formed as a single piece of plastic. The illustrated configuration advantageously permits simplification of the mold. It is to be understood, however, that the inventive concept is not restricted to plastic materials, and broadly relates to a pedestal having one end that is mountable on a primary roof and an opposite end that has a channel to receive a framing member for the supplemental roof. A wide variety of shapes and configurations, single-piece or otherwise, fall within the purview of the invention. As well, the invention contemplates the use of multiple plastic parts, which are fitted or otherwise joined together to form the pedestal 18.

Referring again to FIG. 4, the preferred embodiment of the invention is shown in greater detail. The pedestal 18 has a vertical support 20 that is generally rectangular in cross section with a pair of opposed minor side surfaces 22 and a pair of opposed major side surfaces 24. The outer end of the vertical support 20 has a generally U-shaped, open-ended channel 26, which extends between the two minor side surfaces 22 and which has a support surface 27 upon which the framing member 11 rests. The channel 26 is configured and dimensioned to be complementary to the framing member 11 so that the inner surfaces of the upstanding legs 25 thereof engage the framing member. Holes 23 are provided to receive nails 21 or other suitable fasteners to secure the framing member in the channel.

Where plastic construction is used, it is desirable to increase the strength of the pedestal by forming the vertical support 20 with a honeycomb core having the rectangular cells. With this arrangement, the outer end of the honeycomb core forms the support surface 27 of the channel. It will be appreciated that the use of rectangular cells having walls that are oriented in parallel or perpendicular relationship to the minor and major side surfaces 22 and 24, respectively, facilitates the plastic-molding process. It is to be understood, of course, that cells having other than rectangular construction may be used. To enhance the insulating value of the pedestal, the cells of the honeycomb core 28 are preferably filled with an insulating material (not shown). A foamed in situ polymeric material is presently preferred.

Figure 5:
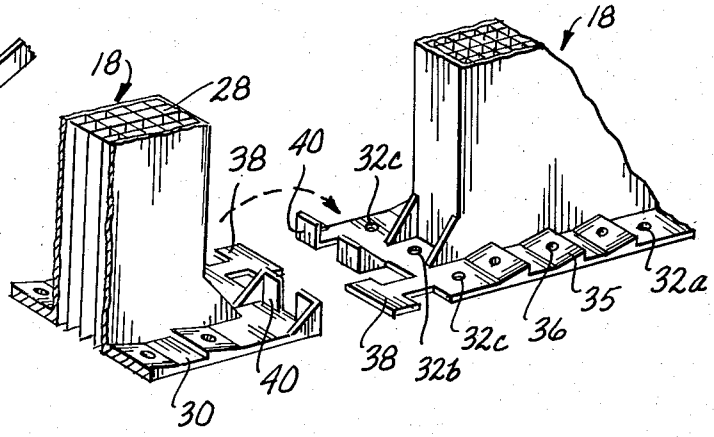
FIG. 5 is a perspective view in partial section showing the interlocking tab and receptacle that are used to interconnect two pedestals at the peak of a roof.

The lower end of the pedestal is a plate-like base 30 that forms a mounting flange around the lower periphery of the vertical support 20. To provide level contact with the planks 12 of the primary roof, the lower surface of the base 30 is substantially planar. While the major and minor side surfaces 24 and 22 of the vertical support may be inclined at an angle relative to the lower surface of the base 30, it is preferred that these surfaces be oriented at substantially right angles thereto. With this arrangement, it is also preferred that the support surface 27 of the channel 26 be substantially parallel to the lower surface of the base 30 so that the framing member 11 will be supported in generally parallel relation to the planks 12 of the primary roof. The base 30 includes a plurality of apertures that are located and sized to receive two different types of fasteners. Holes 32*a*, 32*b*, and 32*c* are provided to receive lags 34 to anchor the pedestal and the tension strap 19 to the underlying beam 14 of the primary roof. The selection of the particular hole 32*a*, 32*b*, or 32*c* is determined by whether the pedestals are oriented perpendicular to the underlying beams of the primary roof as in FIG. 2 or parallel to the underlying beams or rafters of the primary roof as in FIG. 3. For example, in FIG. 4, lag 34 is used in conjunction with hole 32*a* to fasten the pedestal and the tension strap 19 to the beam 14. In FIG. 4, the lag designated 34' would not be used with the illustrated roof. Rather, this lag would be used in conjuction with hole 32*b* to anchor the pedestal to one of the rafters 15 in the FIG. 3 arrangement. The holes 32*c* (see also FIG. 5) would be used with lags to anchor the pedestals to the beam 14 at the peak labelled P in FIG. 2. It is to be noted that, using the holes 32*a* and 32*c*, conventional metal or plastic braces can be connected from the base of one pedestal to the framing member supported by a laterally adjacent pedestal for added strength or to comply with local building codes.

A plurality of holes 36 are provided on raised bevels 35 to receive nails (not shown) that attach the pedestal to the planks 12. The raised bevels 35 are provided so that the nails will be at an angle to increase the pull-out loading. In addition, the raised bevels strengthen the connection.

To aid in the control of roll-over, it is highly desirable to provide connection between the supplemental roof framing structure on the one side of the roof with the framing structure on the opposite side. Referring to FIGS. 2 and 3, it will be seen that one pedestal from each of the two sides of the roof is positioned at the peak P of the primary roof. To accomplish the objective of interconnecting the framework on the two sides of roof, these two adjacent pedestals have means for connecting with each other. The preferred arrangement for the connecting means is shown in detail in FIGS. 4 and 5. One of the shorter, or minor, side edges of the base 30 has a tab 38 and receptacle 40 extending therefrom. The tab 38 and receptacle 40 are configured to be complementary to one another so that the tab and receptacle of one pedestal are respectively engageable with the receptacle and tab of another pedestal. Advantageously, this arrangement provides a hinge-like connection so that the two pedestals may be easily positioned in accordance with the slopes on the two sides of the primary roof. It is to be appreciated that other arrangements for connecting the two adjacent pedestals at the peak P of the roof can be used. For example, the pedestals could be formed to resemble a conventional hinge and joined with a pin. Although an ability to pivot the two pedestals relative to one another is highly desirable, other nonpivoting connecting arrangements could be employed to join these two pedestals. In keeping with the aim of providing a single universal construction element, it is preferred that each pedestal include a tab and receptacle, rather than providing specialized pedestals solely for the peak.

Figure 7:
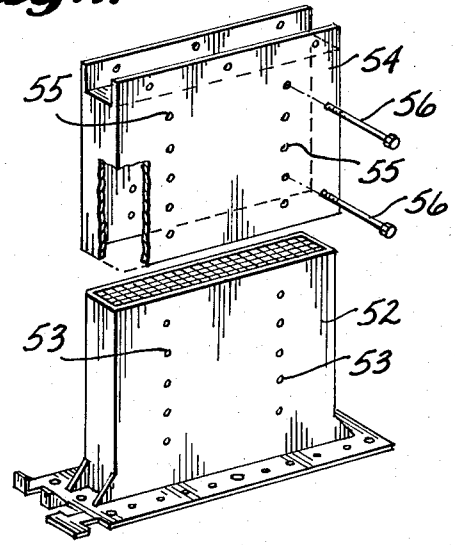
FIG. 7 is a perspective view showing alternate embodiments of the pedestal and extension cap.
Figure 6:
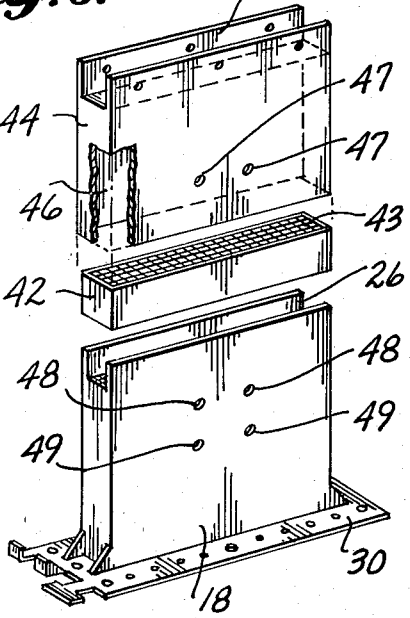
FIG. 6 is an exploded perspective view showing the preferred form of extension cap and spacer block.

As noted above, the spacing between the primary and supplemental roofs can be adjusted by using different sizes of framing members 11. FIGS. 6 through 7 illustrate alternate embodiments that permit adjustment of the height of the pedestal, and a corresponding adjustment of the spacing between the supplemental and primary roofs. Referring first to FIG. 6, the universal fixed pedestal 18 of FIG. 4 is shown in simplified form for clarity of illustration. To increase the height of the fixed pedestal 18, a spacer block 42 is positioned in the channel 26. Thereafter, an extension cap 44 is positioned over the spacer block 42 and pedestal 18. As will be apparent, both the internal cavity 46 of the extension cap and the spacer block are configured to be complementary to one another and to the pedestal so that a good receiving fit is provided. In the illustrated preferred arrangement, the rectangular cross-sectional configuration of the spacer block 42 is complementary to the configuration of the channel 26, while the rectangular cross-sectional configuration of the internal cavity 46 of the extension cap is complementary to the rectangular cross-sectional configuration of the pedestal 18.

When the cap is fully seated on the spacer block 42 and pedestal 18, holes 47 therein are aligned with holes 48 in pedestal 18. Fasteners, not shown in FIG. 6, are then passed through the aligned holes to secure the cap to the pedestal.

Figure 11:
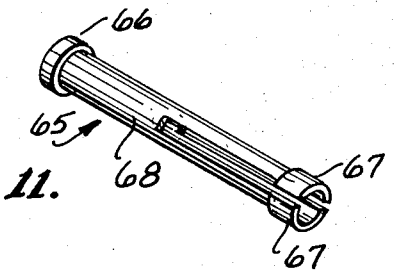

The fasteners may be either conventional bolts and nuts or plastic pins. To avoid condensation problems, it is preferable to use plastic materials, such as the plastic pin 65 shown in FIG. 11. This pin has an enlarged head 66 at one end and a slotted shaft 68, which carries two insertion head halves 67. Since the plastic material is flexible, the two head halves 67 may be pressed together to pass through the holes in the extension cap and pedestal. When the pin is fully inserted, the two head halves 67 return to the illustrated spaced-apart position to firmly connect the extension cap in place. An additional advantage of a snap-in pin such as that of FIG. 11 is that installation thereof is less labor-intensive than installation of bolts and nuts.

Since the dimensions of the extension cap and base can be selected as desired, it is not essential that the spacer block 42 be utilized. When the spacer block 42 is not employed, the extension cap 44 would rest directly upon the top of the pedestal 18 so that the holes 47 are aligned with the holes 49 for receipt of the bolts.

The extension cap 44 also includes a generally U-shaped upper channel 50 that is configured and dimensioned to receive the framing members 11 of the supplemental roof. As will be seen, the channel 50 is substantially identical in configuration to the channel 26 of the pedestal. Thus, with or without the spacer block 42, the addition of the extension cap 44 results in the framing member 11 being spaced further away from the primary roof than it would be using the pedestal 18, alone. In preferred form, both the extension cap 44 and the spacer block 42 are constructed as single pieces of plastic. When so constructed, it is also preferred that the spacer block have a honeycomb core that can be filled with an insulating material such as a foamed in situ polymeric material. Rather than using a special, plastic part, the spacer block 42 can alternatively be simply a cut segment of a wooden framing member, such as a two-by-four. It is to be observed that the dimensions of the spacer block will in part dictate the location of the holes 47 in the extension cap and the holes 48 and 49 in the pedestal 18. There can, of course, be more or fewer holes than illustrated in FIG. 6, depending upon the particular application.

FIG. 7 illustrates another embodiment that permits adjustment of the spacing between the supplemental and primary roofs. In this arrangement, a modified pedestal 52 does not have a channel at its upper end. In other respects, this pedestal is identical to the pedestal illustrated in FIG. 6, being preferably constructed as a single piece of plastic with a honeycomb core. The extension cap 54 is identical to the extension cap 44 of FIG. 6, with the exception that a plurality of holes 55 are provided for alignment with holes 53 in the pedestal 52. When the cap 54 is positioned on the pedestal 52, one or more fasteners 56 are passed through one or more of the aligned holes 53 and 55. The fasteners 56 may be conventional bolts and nuts but are preferably plastic fasteners such as the ones shown in FIG. 11. Although not illustrated, it is to be understood that a spacer block could be utilized with this arrangement.

Figure 8:
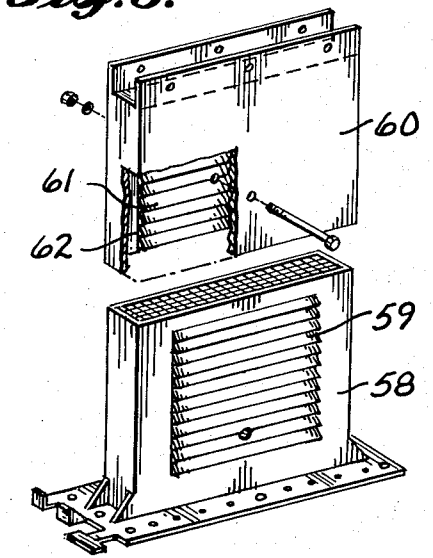
FIG. 8 is an exploded perspective view showing yet another alternate embodiment of the pedestal and extension cap.

Yet another arrangement for adjusting the extension cap relative to the pedestal is shown in FIG. 8. In this embodiment, the two major faces of the modified pedestal 58 have a series of ratchets 59 that are engageable by complementary configured ratchets 61 on the two interior major surfaces 62 of the modified extension caps 60. As will be readily understood, an interlocking fit between the ratchet 61 and ratchets 59 will position the cap at a desired height. Thereafter, one or more bolts can be used to secure the cap in this position.

With regard to the three embodiments of FIGS. 6, 7, and 8, it is to be observed that the various holes in the extension caps and bases can be formed either during manufacture, or drilled on the spot, during construction of the supplemental roof. This latter approach may be desirable, particularly where a variety of sizes of spacer blocks are likely to be required.

Figure 9:
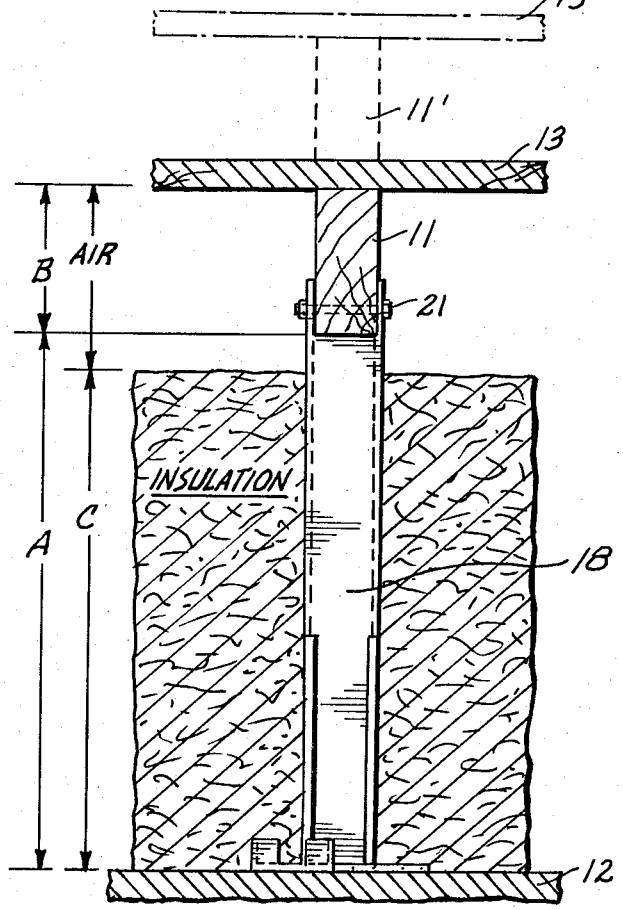
FIG. 9 is a side elevation view of an installed pedestal, with a framing member mounted therein supporting a supplemental roof in relation to a primary roof.

FIG. 9 illustrates the manner in which the fixed pedestal 18 can be used in conjunction with two differently sized framing members to provide a spacing between the supplemental and primary roof that will accommodate the desired thickness of insulation and airspace. In the illustrated side view, a pedestal 18 is mounted on the planks 12 of the primary roof. A framing member 11 is secured in the channel of the pedestal by nails 21 that pass through apertures 23 (see FIG. 4). In turn, sheathing 13 is secured, as for example, by nailing, to the framing member 11. The distance A is the height of the channel, or the distance between the support surface of the channel and the base of the pedestal 18. The distance B represents the widest dimension of the framing member 11 and the distance C represents the thickness of insulation for the roof. By selecting the distance A, a suitable airspace designated "AIR" can always be provided above the insulation. For example, using conventional materials, an insulating value of R38 can be achieved with a 12-inch thick blanket. Thus, for this example, dimension C in FIG. 9 is 12 inches. By selecting dimension A to be 13 inches, and by using a standard two-by-four, which is approximately 3½ inches wide (dimension B), an airspace above the insulation of approximately 4½ inches is achieved.

When heavy snow loads necessitate use of a larger framing member 11', it will be seen from FIG. 9, that the space between the sheathing 13' for the supplemental roof and the planks 12 of the primary roof is correspondingly increased so that additional thicknesses of insulation may be used while still assuring an adequate airspace thereabove.

Figure 10:
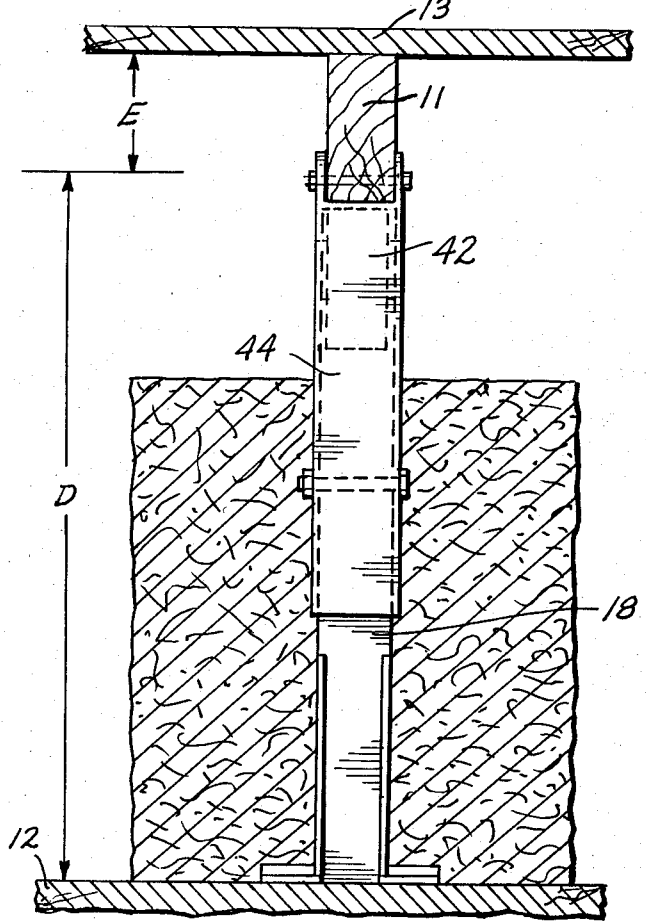
FIG. 10 is a side elevation view of an assembled pedestal, spacer block, and extension cap supporting a supplemental framing member and roof in relation to a primary roof.

FIG. 10 illustrates the use of the extension cap 44 and the spacer block 42 to increase the spacing between the supplemental and primary roofs. Without the use of the extension cap and spacer block, the pedestal 18, alone, with a framing member 11 in the channel thereof, would position the sheathing 13 of the primary roof generally at the height D (when using a framing member of essentially the same size as framing member 11). By adding the spacer block 42 and extension cap 44, the sheathing 13 is extended an additional distance E above the planks 12 of the primary roof. This additional spacing can then be used to accommodate further thicknesses of insulation.

An important aspect of the invention is a recognition that standard thicknesses of insulation are currently based on standard lumber sizes. For example, an R-11 blanket is configured for use with a two-by-four while an R-19 blanket is configured for use with a two-by-six. The pedestal, the extension cap, and the spacer block are each preferably configured to take advantage of this relationship so that standard thicknesses of insulation, together with a required airspace thereabove are automatically accommodated. In addition to providing the proper relationship between the airspace and insulation, this arrangement virtually eliminates the need to make extensive measurements and consuming costly labor in the construction process.

From the foregoing, it will be seen that the present invention provides a simple, economical-to-manufacture device that can be used in conjunction with standard construction materials to quickly construct a framework for superposing a supplemental roof over a primary roof of a building for insulation purposes. Using economical 2×4, 2×6, and 2×8 material in short lengths spanning the roof from pedestal to pedestal, assures that both labor costs and material costs can be kept to a minimum. The invention is advantageously used to insulate a post-and-beam deck roof in an economical manner that permits preserving the aesthetic benefits of the exposed, wooden, cathedral ceiling.

In contrast to solid rafter, for example, two-by-twelve, construction, the "openness" of the inventive framework offers distinct advantages where it is necessary to add electrical, mechanical, and heating systems. Unlike the solid-rafter construction, where it is necessary to drill holes to run electrical wires, or to cut voids for the passage of mechanical and heating equipment, the present system, with its pedestals spaced apart a considerable distance, greatly facilitates the addition of such systems. This "built-in" clearance can additionally be used to advantage in existing buildings. In particular, many older buildings are being renovated for office space or converted to apartments or condominiums. It is often necessary to upgrade the electrical, mechanical, and other building systems. Since these older buildings typically have high ceilings, it is possible to add a new floor frame and support a new floor over the existing flooring. It will be appreciated that the present invention readily lends itself to use in framing the support for the new floor. It will be appreciated that the advantages discussed above, i.e., those that relate to material and labor savings, the provision of a void for electrical, mechanical, and heating systems, and the like, apply equally when the invention is used for a floor support. If desired, the pedestals could be used in a reverse attitude to form a framework for a suspended ceiling. In this manner, heating ducts, electrical wiring, and the like could be run between the old and new ceilings or insulation or sound control could be provided between the floors.

The present invention has been described in relation to its preferred embodiments. One of ordinary skill, after reading the foregoing specification, will be able to effect various changes and substitutions of equivalents without departing from the broad concepts disclosed herein. It is therefore intended that the protection afforded by Letters Patent granted hereon be limited only by the definition contained in the appended claims and equivalents thereof.

The embodiments of the invention in which an exclusive property or privilege is claimed are defined as follows:

1. A framing system for use in supporting a supplemental roof in superposed spaced relation to a primary roof of a building, said primary roof having a layer of boards overlying a plurality of framing members, comprising:

a plurality of like-configured pedestals positioned at spaced-apart locations on said layer of boards, each of said pedestals being disposed in superposed relation to a selected framing member of said primary roof, each of said pedestals having opposed first and second ends, the first end of each pedestal being oriented toward said layer of boards, the second end of each pedestal being oriented away from said layer of boards and having a channel that is adapted to receive a framing member of the supplemental roof, said pedestals being oriented so that the respective channels thereof are cooperatively aligned;

fastening means for connecting each of said pedestals, respectively, to the selected framing member of said primary roof; and a supplemental framing member mounted in the aligned channels of said pedestals.

2. The framing system of claim 1, wherein said primary roof is a pitched roof, and wherein:

said plurality of pedestals are arranged in cooperating groups on opposite sides of said primary roof, the pedestals within each group being oriented so that the respective channels thereof are cooperatively aligned, for each group, a supplemental framing member being mounted in the channels of said pedestals, the pedestals within a group on one side of said primary roof being cooperatively oriented relative to the pedestals within a group on the opposite side thereof so that each supplemental framing member on one side of said primary roof is aligned with a supplemental framing member on the opposite side of said roof.

3. The framing system of claim 2, wherein, at the peak of said roof, for each cooperating group of pedestals, a pedestal within the group on one side of said primary roof is positioned adjacent and connected to a pedestal within the group on the other side of said primary roof.

4. A device for use in supporting a supplemental roof in superposed spaced relation to a primary roof of a building, comprising a plastic pedestal having opposed first and second ends, said first end being constructed so as to be mounted on the primary roof, said second end having a channel that is constructed and arranged so as to receive a framing member of the supplemental roof and orient the same in spaced relation to the primary roof, said pedestal having a honeycomb core.

5. The device of claim 1, wherein said pedestal has a mounting flange at said first end, said mounting flange including means for connecting said pedestal with another like-configured pedestal.

6. The device of claim 5, wherein said means for connecting comprises a tab and a receptacle, said tab and receptacle being configured complementary to, and disposed relative to, one another so tht the tab and receptacle of said pedestal are engageable with the receptacle and tab, respectively, of another like-configured pedestal.

7. The device of claim 1, further including:

an extension cap having a channel that is constructed and arranged so as to receive a framing member of the supplemental roof, said cap being slidably mountable upon said pedestal so that the channel of said cap is positionable in selective, spaced relation to the channel of said pedestal.

8. A plastic device for use in constructing a roof of a building, comprising:

a plate-like base having a generally rectangular configuration, with opposed upper and lower surfaces and with opposed minor side edges and opposed major side edges, said major side edges joining said minor side edges, the lower surface of said base being substantially planar; and a vertical support having a generally rectangular cross-sectional configuration with opposed minor side surfaces and opposed major side surfaces joining said minor side surfaces, said vertical support being centrally positioned on the upper surface of said base, the major and minor side surfaces of said support being aligned substantially parallel to the respective major and minor side edges of said base and extending outward from the upper surface of said base at substantially right angles to the lower surface thereof, said support having an open-ended channel at the outer end thereof, said channel extending between said minor side surfaces and having a support surface that is oriented at a predetermined angle relative to the lower surface of said base, said vertical support including a honeycomb core having cells that are oriented along axes that are generally parallel to the major and minor side surfaces of said support.

9. The device of claim 8, wherein the support surface of said channel is oriented generally parallel to the lower surface of said base.

10. A device for use in supporting a supplemental roof in superposed spaced relation to a primary roof of a building, comprising a single-piece plastic pedestal having opposed first and second ends, said first end being constructed so as to be mounted on the primary roof, said second end having a channel that is constructed and arranged so as to receive a framing member of the supplemental roof and orient the same in spaced relation to the primary roof, said pedestal having a mounting flange at said first end, said mounting flange including a tab and a receptacle, said tab and receptacle being configured complementary to, and disposed relative to, one another so that the tab and receptacle of said pedestal are engageable with the receptacle and tab, respectively, of another like-configured pedestal.

11. The device of claim 10, wherein said pedestal has a honeycomb core.

12. The device of claim 11, wherein said honeycomb core is filled with an insulating material.

13. A device for use in supporting a supplemental roof in superposed spaced relation to a primary roof of a building, comprising:

a pedestal having opposed first and second ends, said first end being constructed so as to be mounted on the primary roof, said second end having a channel that is constructed and arranged so as to receive a framing member of the supplemental roof and orient the same in spaced relation to the primary roof;

a spacer block mountable in the channel of said pedestal; and an extension cap having a channel that is constructed and arranged so as to receive a framing member of the supplemental roof, said cap being slidably mountable upon said pedestal so that the channel of said cap is positioned in selective, spaced relation to the channel of said pedestal, said extension cap having an open-ended cavity that is receivable by said pedestal and spacer block.

14. The device of claim 13, wherein said pedestal, extension cap, and spacer block are each a single piece of plastic.

15. The device of claim 14, wherein said pedestal and said spacer block each have a honeycomb core.

16. The device of claim 15, wherein the honeycomb cores of said pedestal and said spacer block are each filled with an insulating material.

17. The device of claim 16, further including means for securing said extension cap to said pedestal.

18. A device for use in constructing a roof of a building, comprising:

a plate-like base having a generally rectangular configuration, with opposed upper and lower surfaces and with opposed minor side edges and opposed major side edges, said major side edges joining said minor side edges, the lower surface of said base being substantially planar, said base including a tab and a receptacle extending from one of said minor side edges, said tab and receptacle being configured complementary to, and disposed relative to, one another so that the tab and receptacle of said device are respectively engageable with the receptacle and tab of another like-configured device; and a vertical support having a generally rectangular cross-sectional configuration with opposed minor side surfaces and opposed major side surfaces joining said minor side surfaces, said vertical support being centrally positioned on the upper surface of said base, the major and minor side surfaces of said support being aligned substantially parallel to the respective major and minor side edges of said base and extending outward from the upper surface of said base at substantially right angles to the lower surface thereof, said support having an open-ended channel at the outer end thereof, said channel extending between said minor side surfaces and having a support surface that is oriented at a predetermined angle relative to the lower surface of said base, said support surface being oriented generally parallel to the lower surface of said base.

19. The device of claim 18, wherein said base and said vertical support comprise a single piece of plastic.

20. The device of claim 19, wherein said vertical support includes a honeycomb core having cells that are oriented along axes that are generally parallel to the major and minor side surfaces of said support.

21. The device of claim 20, wherein the cells of said honeycomb core are filled with insulating material.

22. A device for use in constructing a roof of a building, comprising:

a plate-like base having a generally rectangular configuration, with opposed upper and lower surfaces and with opposed minor side edges and opposed major side edges, said major side edges joining said minor side edges, the lower surface of said base being substantially planar;

a vertical support having a generally rectangular cross-sectional configuration with opposed minor side surfaces and opposed major side surfaces joining said minor side surfaces, said vertical support being centrally positioned on the upper surface of said base, the major and minor side surfaces of said support being aligned substantially parallel to the respective major and minor side edges of said base and extending outward from the upper surface of said base at substantially right angles to the lower surface thereof, said support having an open-ended channel at the outer end thereof, said channel extending between said minor side surfaces and having a support surface that is oriented at a predetermined angle relative to the lower surface of said base; and an extension cap having a generally rectangular cross-sectional configuration with opposed minor side surfaces and opposed major side surfaces joining said minor side surfaces, said cap having an internal cavity that in cross section is configured complementary to the rectangular configuration of said vertical support, said internal cavity being slidably receivable by said vertical support, said cap having an open-ended channel at an outer end thereof, said channel extending between said minor side surfaces and having an inner support surface.

23. The device of claim 22, wherein said base, said vertical support and said extension cap are each formed from plastic material.

24. The device of claim 23, wherein said vertical support has a honeycomb core.

25. The device of claim 24, wherein said base and said vertical support comprise a single piece of plastic, and wherein said extension cap is a single piece of plastic.

26. The device of claim 24, wherein the honeycomb core of said vertical support is filled with an insulating material.

27. The device of claim 22, further including a space block that is mountable in the channel of said vertical support, said spacer block having a cross-sectional configuration that is complementary to the configuration of said channel and to the rectangular configuration of said vertical support, said spacer block, when mounted in said channel, being receivable by the internal cavity of said extension cap.

28. The device of claim 27, wherein said base, said vertical support, and said extension cap are each formed from plastic material.

29. The device of claim 28, wherein said vertical support has a honeycomb core.

30. The device of claim 29, wherein said base and said vertical support comprise a single piece of plastic, and wherein said extension cap is a single piece of plastic.

31. The device of claim 30, wherein said spacer block is a single piece of plastic having a honeycomb core.

32. The device of claim 31, wherein the honeycomb cores of said vertical support and said spacer block are each filled with an insulating material.

33. A device for use in constructing a building, comprising a plastic pedestal having opposed first and second ends, said first end being constructed so as to be mounted on a substantially planar support surface of a building, said second end having a channel that is constructed and arranged so as to receive a framing member and orient the same in spaced relation to said support surface, said pedestal having a honeycomb core.

34. The device of claim 33, further including:

an extension cap having a channel that is constructed and arranged so as to receive a framing member, said cap being slidably mountable upon said pedestal so that the channel of said cap is positionable in selective, spaced relation to the channel of said pedestal.

35. The device of claim 34, further including a spacer block mountable in the channel of said pedestal; and wherein, said extension cap has an open-ended cavity that is receivable by said pedestal and spacer block.

* * * * *

UNITED STATES PATENT AND TRADEMARK OFFICE

CERTIFICATE OF CORRECTION

PATENT NO. : 4,631,878

DATED : December 30, 1986

INVENTOR(S) : Larry W. Laramore

It is certified that error appears in the above-identified patent and that said Letters Patent is hereby corrected as shown below:

Column 13, line 21: "1" should be --4--
Column 13, line 32: "1" should be --4--

Signed and Sealed this

Twenty-fifth Day of October, 1988

*Attest:*

DONALD J. QUIGG

*Attesting Officer*

*Commissioner of Patents and Trademarks*